US006854814B1

(12) United States Patent
Gardner et al.

(10) Patent No.: US 6,854,814 B1
(45) Date of Patent: Feb. 15, 2005

(54) POINT OF SALE DISPLAY STATION

(75) Inventors: Scott R. Gardner, Rockaway Township, NJ (US); Joseph Gerardiello, Sparta, NJ (US)

(73) Assignee: InterMarket Technology, Inc., Wayne, NJ (US)

( * ) Notice: Subject to any disclaimer, the term of this patent is extended or adjusted under 35 U.S.C. 154(b) by 42 days.

(21) Appl. No.: 10/288,341

(22) Filed: Nov. 5, 2002

(51) Int. Cl.[7] ..... A47B 88/00; A47B 81/00; A47F 3/00

(52) U.S. Cl. ..... 312/138.1; 312/234.1; 312/234.3; 312/323; 312/328

(58) Field of Search ..... 312/328, 323, 312/234.1, 234.3, 138.1

(56) References Cited

U.S. PATENT DOCUMENTS

| | | | | | |
|---|---|---|---|---|---|
| 559,709 | A | * | 5/1896 | Hoff | 312/209 |
| 1,471,757 | A | * | 10/1923 | Thiriot | 312/208.4 |
| 1,671,359 | A | | 5/1928 | Feist | |
| 1,696,317 | A | | 12/1928 | O'Boyle | |
| 1,774,520 | A | * | 9/1930 | Lyford | 280/47.33 |
| 2,164,133 | A | * | 6/1939 | Efron | 211/11 |
| 2,679,444 | A | | 5/1954 | Bennett | |
| 3,123,389 | A | * | 3/1964 | Biesecker | 292/218 |
| 4,679,339 | A | | 7/1987 | Hetzer | |
| 5,056,878 | A | | 10/1991 | Givens | |
| 6,102,496 | A | | 8/2000 | Parham | |
| 2002/0158554 | A1 | * | 10/2002 | Lucht et al. | 312/122 |

* cited by examiner

*Primary Examiner*—Peter M. Cuomo
*Assistant Examiner*—Sara C. Bumham
(74) *Attorney, Agent, or Firm*—Richard M. Goldberg

(57) ABSTRACT

A point of sale display station for holding products to be sold, includes a peripheral wall which forms an enclosure for the products, the peripheral wall having a front open area for removal of the products from the enclosure; a roof secured to the peripheral wall, the roof extending substantially to a front surface of the display station; a cover pivotally mounted at a top front section of the peripheral wall for movement between a first position in covering relation to the front open area and a second position above the front open area and substantially flush and parallel with the front surface of the display station, the cover including a display arrangement on a rear surface thereof for providing information regarding the products in the enclosure; and a securing arrangement for releasably securing the cover in the first and second positions.

24 Claims, 9 Drawing Sheets

POINT OF SALE DISPLAY STATION

BACKGROUND OF THE INVENTION

The present invention relates generally to point of sale display stations, and more particularly, is directed to a point of sale display station for use outdoors to protect and display items for sale.

It is known to provide point of, sale display stations for use outdoors to protect and display items for sale. For example, a conventional such display station is sold by the assignee of the present application under the trademark "DOCK LOCKER." Such display station is made from heavy-duty steel and plastic for holding numerous items, such as hundreds of twelve packs of soda cans, outside a retail establishment, such as a convenience store, gas station and the like. The display station includes a large front open area and a large top open area to permit easy access to the packs of soda cans. A cover is hinged at the top rear and can fold down over the top and front openings, and lock in position, to prevent theft of the contents while the retail establishment is closed. Such a display station provides an increased selling area for the retail establishment, which generally has limited floor space within the store itself. In addition, the front covering portion of the cover, when folded up to expose the large top and front openings, provides promotional graphics and other information, such as the price, product description, etc. which is readily visible at the point of sale.

However, there are various problems with this known display station. First, when the cover is placed in the raised, open position, the product, for example, packs of soda cans are exposed to sun, rain and snow. It has been found that the printing on the soda cans fades after about thirty hours in the sun. Therefore, a consumer may not want to purchase the goods. Further, the rain and snow fall directly on the product, which is undesirable.

Another problem with such display station is that, when the cover is positioned in covering relation to the top and front openings, a flat horizontal roof is formed. This, however, is disadvantageous for the buildup of snow and rain.

In addition, with this construction, there is very little ventilation with the cover in the closed position. As a result, during hot weather, there is a build-up of heat in the display station, which can damage the products.

Lastly, the front surface of the cover is provided with opposing L-shaped channels for retention of a pricing insert, generally made of a single panel of corrugated cardboard or plastic material. Each time that a price changes, it is necessary to remove the insert, find a different insert with a different price and insert the same. This means that numerous discrete panels of corrugated plastic must be provided with different pricing thereon. Because of the numerous discrete panels that must be used, this can be burdensome.

OBJECTS AND SUMMARY OF THE INVENTION

Accordingly, it is an object of the present invention to provide a point of sale display station that overcomes the problems with the aforementioned prior art.

It is another object of the present invention to provide a point of sale display station in which the cover provides a display which is flush with the front of the display station in the open position.

It is still another object of the present invention to provide a point of sale display station in which the cover is hinged at the top front of the display station.

It is yet another object of the present invention to provide a point of sale display station in which the fixed roof extends to the top front of the display station to limit exposure of the products therein to sun, rain, snow and other elements.

It is a further object of the present invention to provide a point of sale display station in which the roof is sloped so that any rain or snow that falls on the roof does not fall on the products and is quickly removed.

It is a still further object of the present invention to provide a point of sale display station in which the hinges of the cover prevent any rain or snow that slides down the roof from exiting from the front of the display station so as not to interfere with the display of the products therein.

It is a yet further object of the present invention to provide a point of sale display station in which the roof is connected to the rear of the display station by bent flanges that provide gaps as air vents so that air from the outside can circulate within the display station to prevent overheating of the products.

It is another object of the present invention to provide a point of sale display station in which the insert containing the pricing information, which is to be inserted in the L-shaped channels, is a folded insert member which includes a plurality of hinged panels with different pricing or other information thereon.

It is a still further object of the present invention to provide a point of sale display station that is easy and economical to assemble, operate and manufacture.

In accordance with an aspect of the present invention, a point of sale display station for holding products to be sold, includes a peripheral wall which forms an enclosure for the products, the peripheral wall having a front open area for removal of the products from the enclosure; a roof secured to the peripheral wall, the roof extending substantially to a front surface of the display station; a cover pivotally mounted at a top front section of the peripheral wall for movement between a first position in covering relation to the front open area and a second position above the front open area and substantially flush and parallel with the front surface of the display station, the cover including a display arrangement on a rear surface thereof for providing information regarding the products in the enclosure; and a securing arrangement for releasably securing the cover in the first and second positions.

The roof is sloped to remove precipitation therefrom, and preferably has an inverted V-shaped configuration. The peripheral wall includes a rear wall, opposite side walls connected to the rear wall, and a front panel secured to the opposite side walls, and further comprising a bottom wall connected with the peripheral wall.

The securing arrangement includes at least one first swivel plate on the peripheral side wall and at least one second swivel plate on the roof, and the cover includes a panel having at least one opening therein for receiving the at least one first swivel plate in the first position and the at least one second swivel plate in the second position. Each swivel plate has an enlarged head for insertion through the at least one opening, and at least one enlarged head has an opening for receiving a lock.

The cover is formed from a plurality of panels which are hinged together. The cover includes at least one living hinge for hingedly connecting together the panels. Specifically, the cover includes first through fourth the panels which are hinged together in sequence, the first panel being fixed to the top front section of the peripheral wall, the second panel including the display arrangement on a rear surface thereof for providing information regarding the products in the enclosure and the fourth panel including part of the securing arrangement. In addition, the roof is sloped, and the third panel is sloped in the second position and forms a continuation of the sloped roof in the second position. The second panel is substantially flush and parallel with the front surface of the display station in the second position. The first through fourth panels are aligned in a planar configuration in the first position in covering relation to the front open area.

The display arrangement includes at least one set of opposing L-shaped channels and at least one information insert which is insertable within the at least one set of opposing L-shaped channels, at least one information insert being formed by a plurality of panels hinged together in sequence at edges thereof and each panel having different information indicia thereon.

In addition, air vents are provided between the roof and the peripheral wall for the circulation of air into and out of the display station. Specifically, the peripheral wall includes bent over flanges, and the roof includes a bent peripheral flange which overlaps the bent over flanges so as to provide an air gap between the roof and the peripheral wall, and the peripheral wall further includes at least one opening between the bent over flanges which, together with the air gap, defines the air vents.

In accordance with another aspect of the present invention, a point of sale display station for holding products to be sold, includes a peripheral wall which forms an enclosure for the products, the peripheral wall having a front open area for removal of the products from the enclosure; a roof secured to the peripheral wall; a cover pivotally mounted to the peripheral wall for movement between a first position in covering relation to the front open area and a second position above the front open area; a securing arrangement for releasably securing the cover in the first and second positions; and air vents between the roof and the peripheral wall for the circulation of air into and out of the display station.

The above and other objects, features and advantages of the invention will become readily apparent from the following detailed description thereof which is to be read in connection with the accompanying drawings.

DETAILED DESCRIPTION

Figure 1:
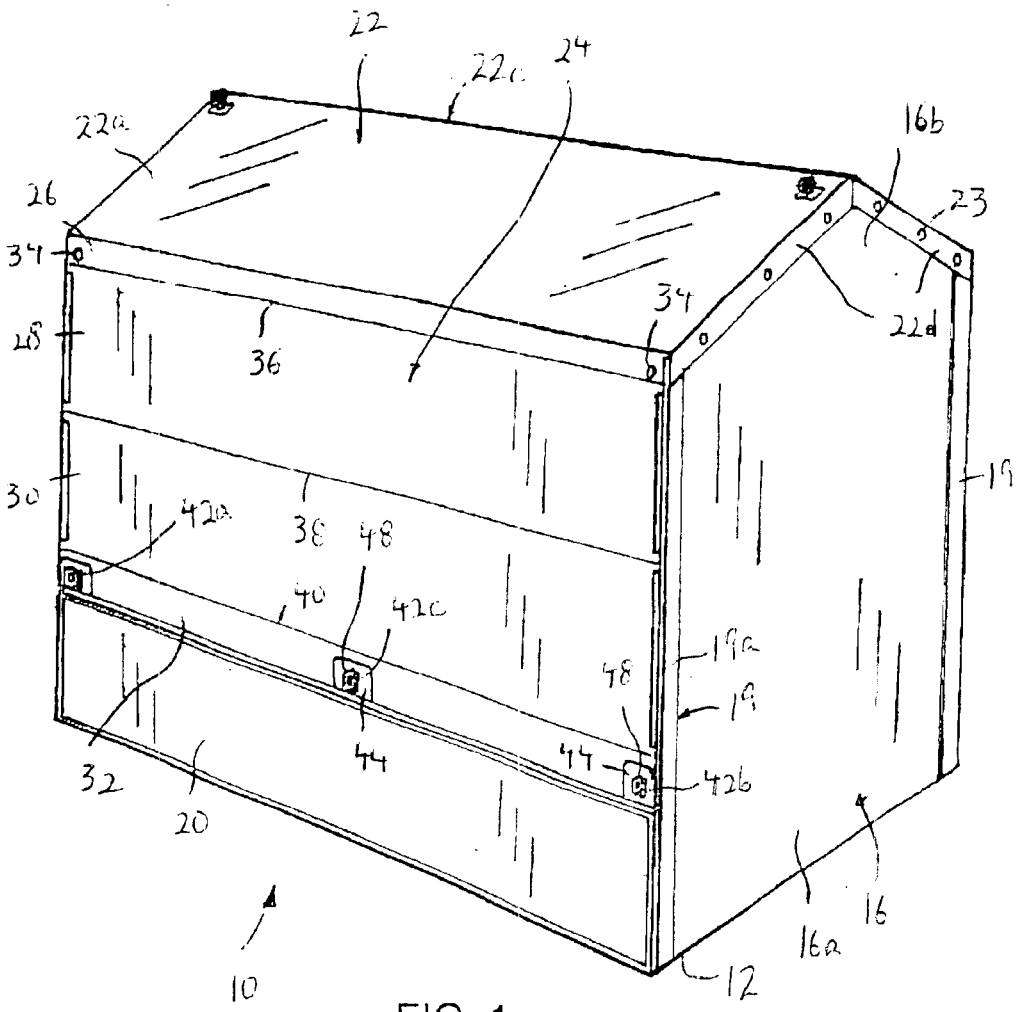
FIG. 1 is a perspective view of a point of sale display station according to the present invention, in a closed configuration.

Referring to the drawings in detail, a point of sale display station 10 according to the present invention includes a rectangular bottom wall 12 and a rectangular rear wall 14 having its bottom edge secured to a rear lengthwise edge of bottom wall 12. A right side pentagonal wall 16 is connected with the right vertical edge of rear wall 14 and with a right side widthwise edge of bottom wall 12, with right side pentagonal wall 16 having a rectangular lower portion 16*a* and a triangular upper portion 16*b*. A left side pentagonal wall 18 is connected with the left vertical edge of rear wall 14 and with a left side widthwise edge of bottom wall 12, with left side pentagonal wall 18 having a rectangular lower portion 18*a* and a triangular upper portion 18*b*. L-shaped channel members 19 are secured to front edges of rectangular lower portions 16*a* and 18*a*, and in particular, have a first elongated leg 19*a* secured to an outer surface of each rectangular lower portion 16*a* and 18*a* at a front edge thereof, and a second elongated leg 19*b* extending slightly inwardly from the respective first elongated leg 19*a*. L-shaped channel members 19 are also secured to rear edges of rectangular lower portions 16*a* and 18*a* and end edges of rear wall 14.

A lower front panel 20 is removably connected by wing nuts (not shown) to the lower ends of second elongated legs 19*b* of L-shaped channel members 19, and can be easily removed for restocking of product. Lower front panel 20 extends about one-third of the height of rectangular lower portions 16*a* and 18*a*, thereby providing a large front opening 21 through which products can be deposited and removed. Because of triangular upper portions 16*a* and 18*a* of pentagonal walls 16 and 18, a roof 22 which is connected to the upper edges of triangular upper portions 16*a* and 18*a* and rear wall 14 has an inverted V-shape configuration, with a forward sloping portion 22*a* and a rearward sloping portion 22*b* meeting at an apex 22*c*. As a result, roof 22 extends to the upper ends of front edges of pentagonal walls 16 and 18 to limit exposure of the products within display station 10 to sun, rain, snow and other elements. Further, because roof 22 is sloped, any rain or snow that falls on roof 22 does not fall on the products and is quickly diverted. Roof 22 has end flanges 22*d* that fold down over and are secured to the upper edges of triangular upper portions 16*a* and 18*a* and rear wall 14 by carriage bolts 23.

In accordance with an important aspect of the present invention, a cover 24 is provided for covering front opening 21, and also serving as a point of sale display. Specifically, cover 24 is formed by first through fourth rectangular panels 26, 28, 30 and 32. First rectangular panel 26 has a relatively narrow width and has opposite ends thereof flush against the upper edges of second elongated legs 19*b* of L-shaped channel members 19 and fixedly secured thereto by bolts 34. Second rectangular panel 28 has its upper lengthwise edge connected to the lower lengthwise edge of first rectangular panel 26 by a living hinge 36 that permits second rectangular panel 28 to be pivoted upwardly from the position shown in FIG. 1 to the position shown in FIG. 6. The use of living hinge 36 provides the advantage that there are no discontinuities resulting from the hinged area. This means that rain and snow which slide down forward sloping portion 22*a* of sloped roof 22 impact at living hinge 36 and then are diverted to the sides of display station 10 for removal, rather than falling down the front of display station 10 where the snow and rain could fall through front opening 21 onto the products.

Figure 6:
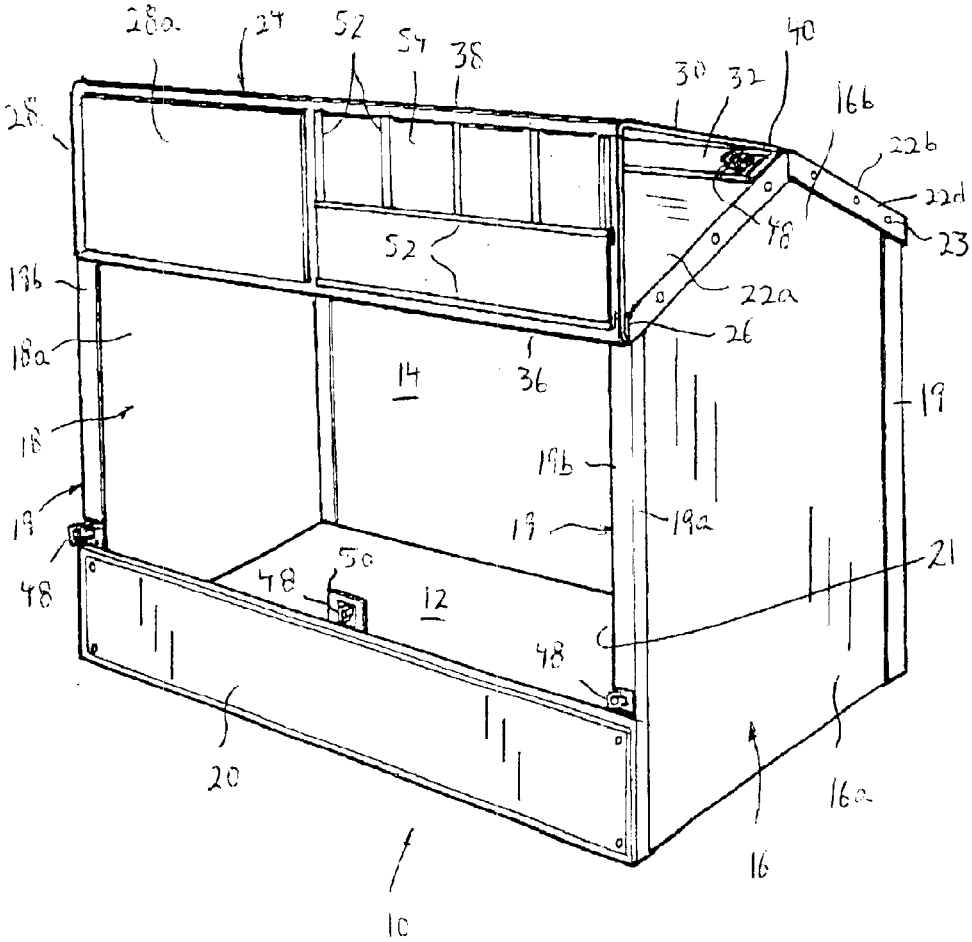
FIG. 6 is a perspective view of a point of sale display station according to the present invention, in an open configuration.
Figure 7:
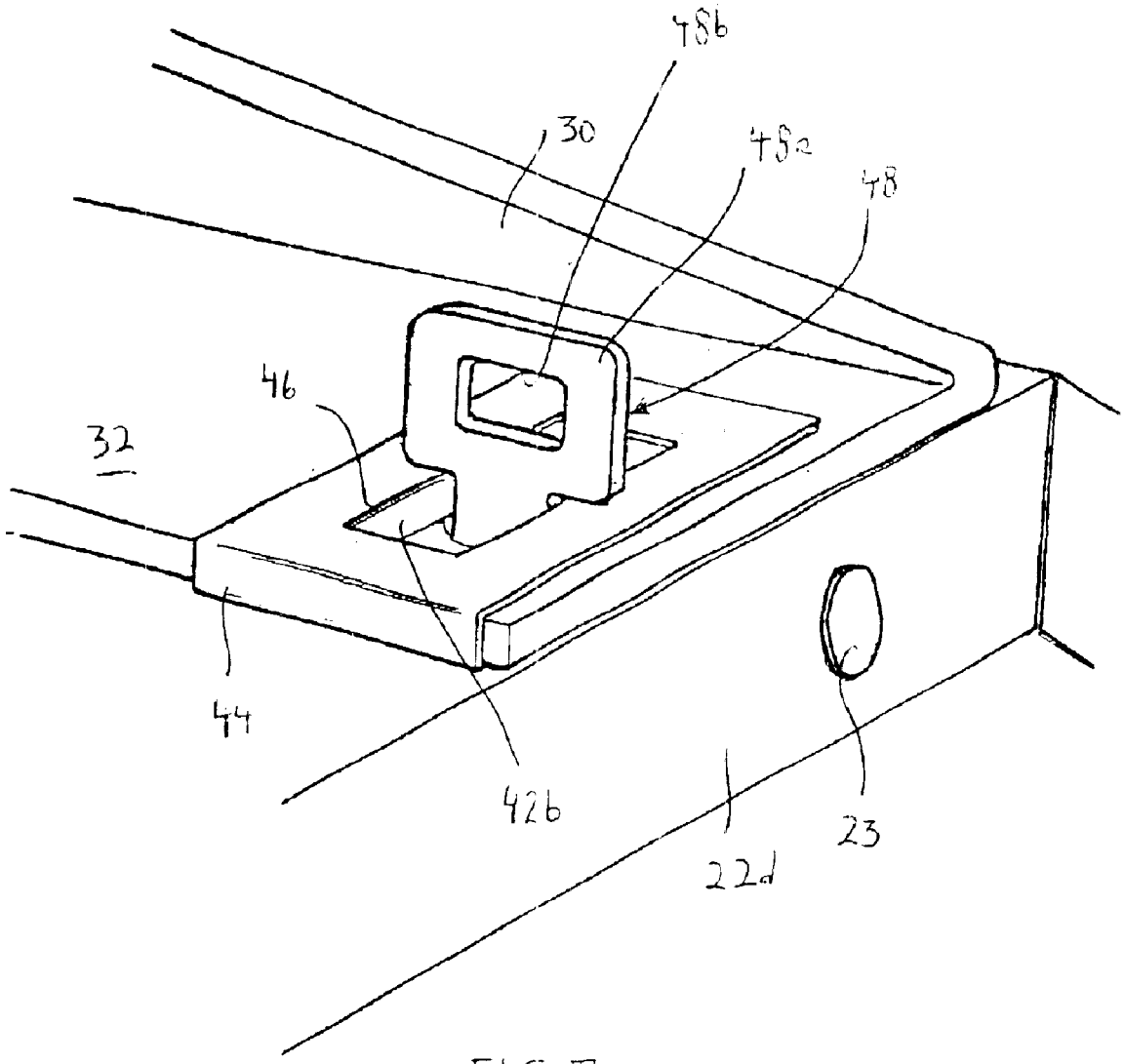
FIG. 7 is perspective view of the roof locking mechanism.

Third rectangular panel 30 has its upper lengthwise edge connected to the lower lengthwise edge of second rectangular panel 28 by a living hinge 38 that permits third rectangular panel 30 to be pivoted upwardly from the position shown in FIG. 1 to the position shown in FIG. 6. Preferably, second and third rectangular panels 28 and 30 are the largest of the rectangular panels and thereby cover the majority of front opening 21 in the closed position of FIG. 1. Fourth rectangular panel 32 has its upper lengthwise edge connected to the lower lengthwise edge of third rectangular panel 30 by a living hinge 40 that permits fourth rectangular panel 32 to be pivoted upwardly from the position shown in FIG. 1 to the position shown in FIG. 6. However, since fourth rectangular panel 32 is used primarily for securement purposes, it is much narrower than second and third rectangular panels 28 and 30, and thereby has a width similar to that of first rectangular panel 26.

Figure 2:
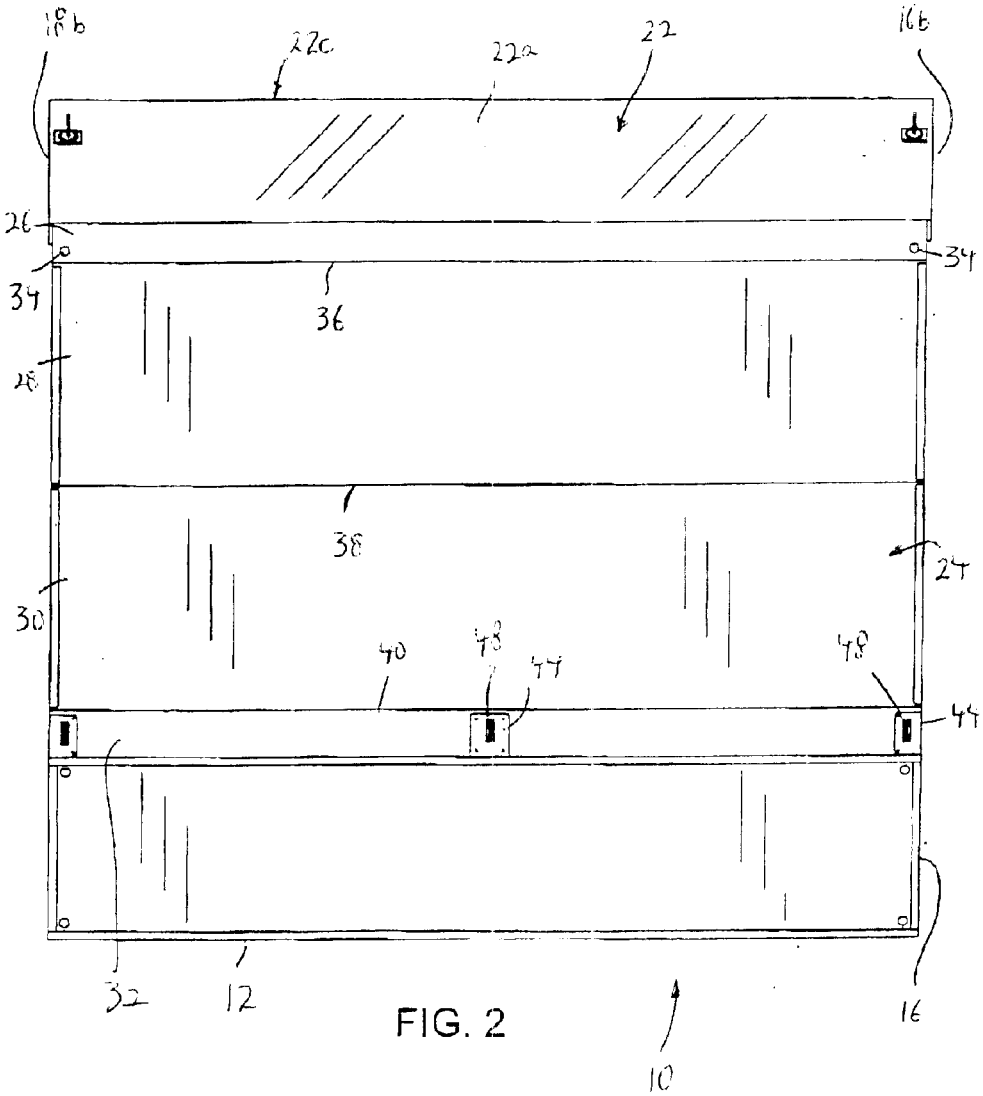
FIG. 2 is a front elevational view of the display station.
Figure 3:
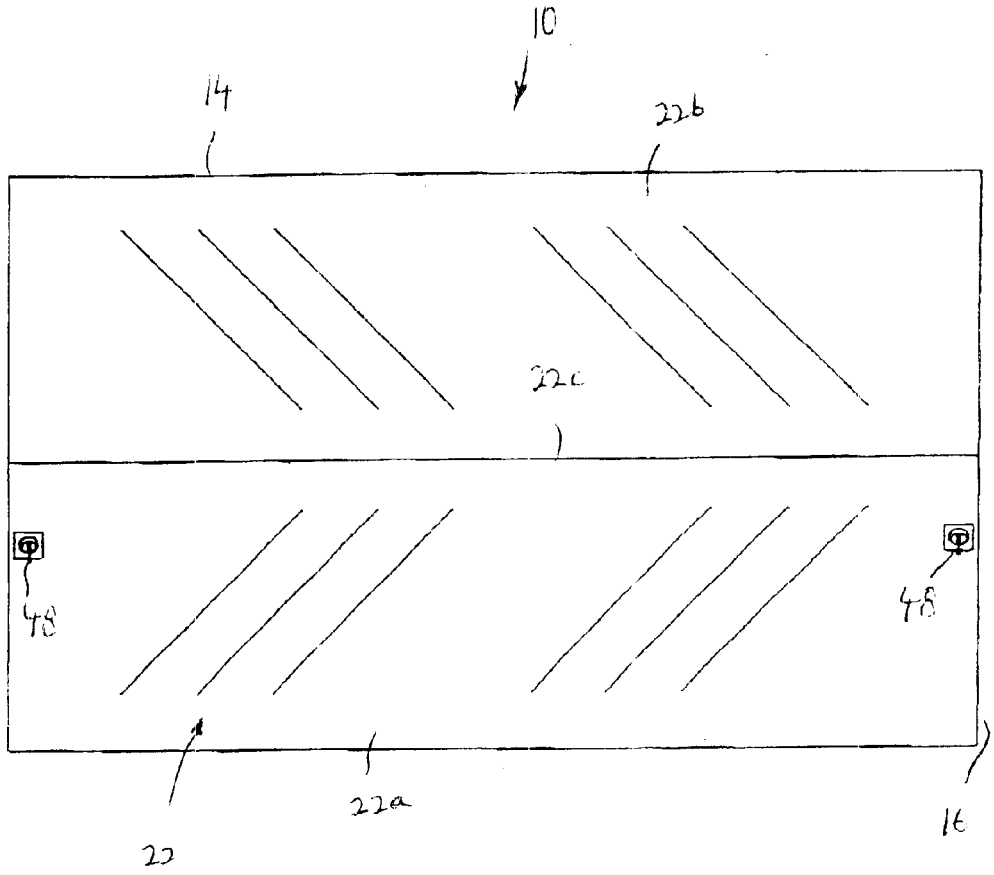
FIG. 3 is a top plan view of the space station.
Figure 4:
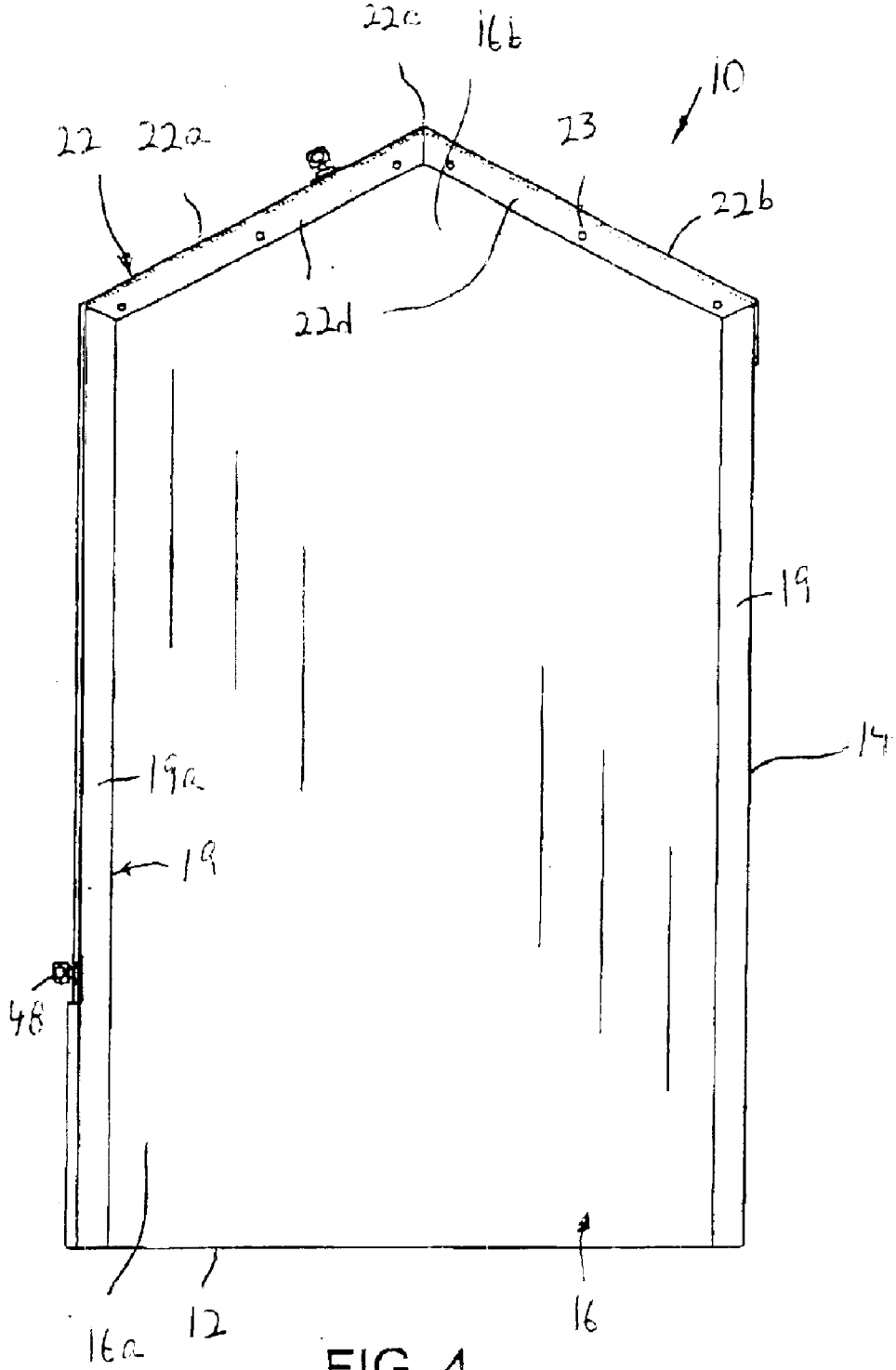
FIG. 4 is a right side elevational view of the space station, the left side being a mirror image thereof.
Figure 5:
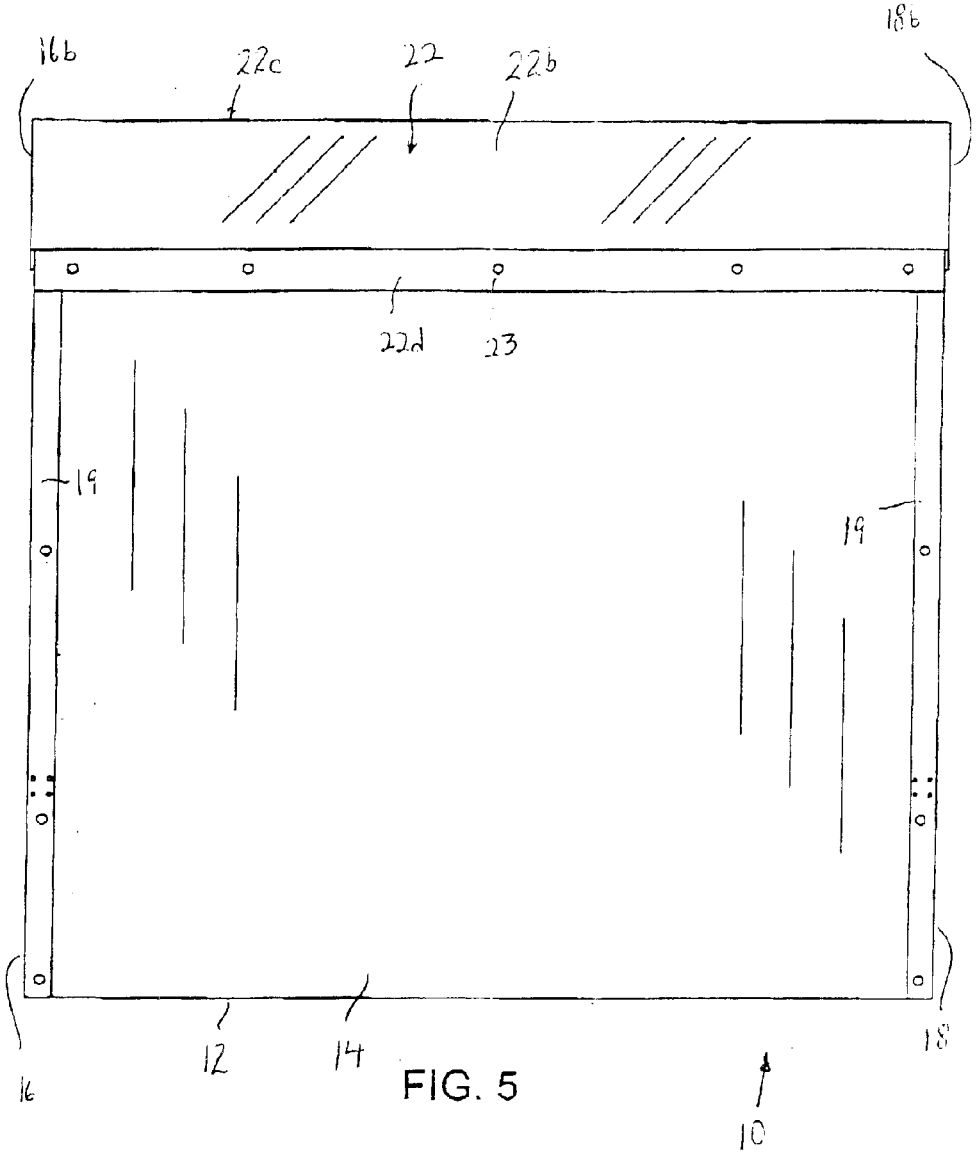
FIG. 5 is a rear elevational view of the space station.

In the closed position of FIGS. 1 and 2, first through fourth rectangular panels 26–32 are aligned with each other so that cover 24 assumes a planar configuration that completely covers front opening 21.

Fourth rectangular panel 32 includes two end slots 42*a* and 42*b*, and a center slot 42*c*. A U-shaped metal reinforcing plate 44 is inserted over fourth rectangular panel 32, from the lower end thereof, in association with each slot 42*a*–42*c*. Each U-shaped metal reinforcing plate 44 includes a slot 46 in alignment with the respective slot 42*a*–42*c*.

A swivel plate 48 is secured to each second elongated leg 19*b* immediately above the upper edge of lower front panel 20, and is also secured to a plate 50 that is secured to the upper end of lower front panel 20. When cover 24 is in the closed position of FIGS. 1 and 2, swivel plates 48 extend through slots 42*a*–42*c* and slots 46. Each swivel plate 48 has a relatively flat, enlarged head 48*a* with an opening 48*b* therein. Thus, when each enlarged head 48*a* is inserted through the respective slots and rotated, cover 24 is locked in position. A combination or key lock can then be inserted through openings 48*b* to prevent opening of cover 24 when the retail establishment is closed, thereby providing a security feature for the goods inside of display station 10.

In the open configuration shown in FIG. 6, rectangular sections 28, 30 and 32 are formed in a substantially triangular configuration, so as to be positioned on forward sloping portion 22*a* of roof 22. In this configuration, second rectangular section 28 extends vertically up from living hinge 36 so as to be flush with the front of display station 10 in the open position, and third rectangular section 30 is sloped down rearwardly substantially as a continuation of rearward sloping portion 22*b* of roof 24, although it need not be at the same angle of inclination of rearward sloping portion 22*b*. The reason for the flush arrangement of second rectangular panel 28 is that cover 24 is hinged at the top front of display station 10. Because of this arrangement, roof 22 can extend to the top front of display station 10 to limit exposure of the products therein to sun, rain, snow and other elements.

Further swivel plates 48 are secured to opposite ends of forward sloping portion 22*a* of roof 22 adjacent apex 22*c*. When cover 24 is in the open position of FIG. 6, swivel plates 48 extend through slots 42*a* and 42*b* and slots 46. Thus, when each enlarged head 48*a* is inserted through the respective slots 42*a*, 42*b* and 46 and rotated, cover 24 is locked in the open position.

Alternatively, magnets can be used at the positions of swivel plates 48 and slits 42*a*–42*c* to hold cover 24 in the open and closed positions. In such case, a transverse flange can be provided at the lower edge of rectangular panel 32 and a similar transverse flange can be provided at the upper edge of front panel 20 for abutting thereagainst, each having aligned holes for receiving a padlock.

Figure 8:
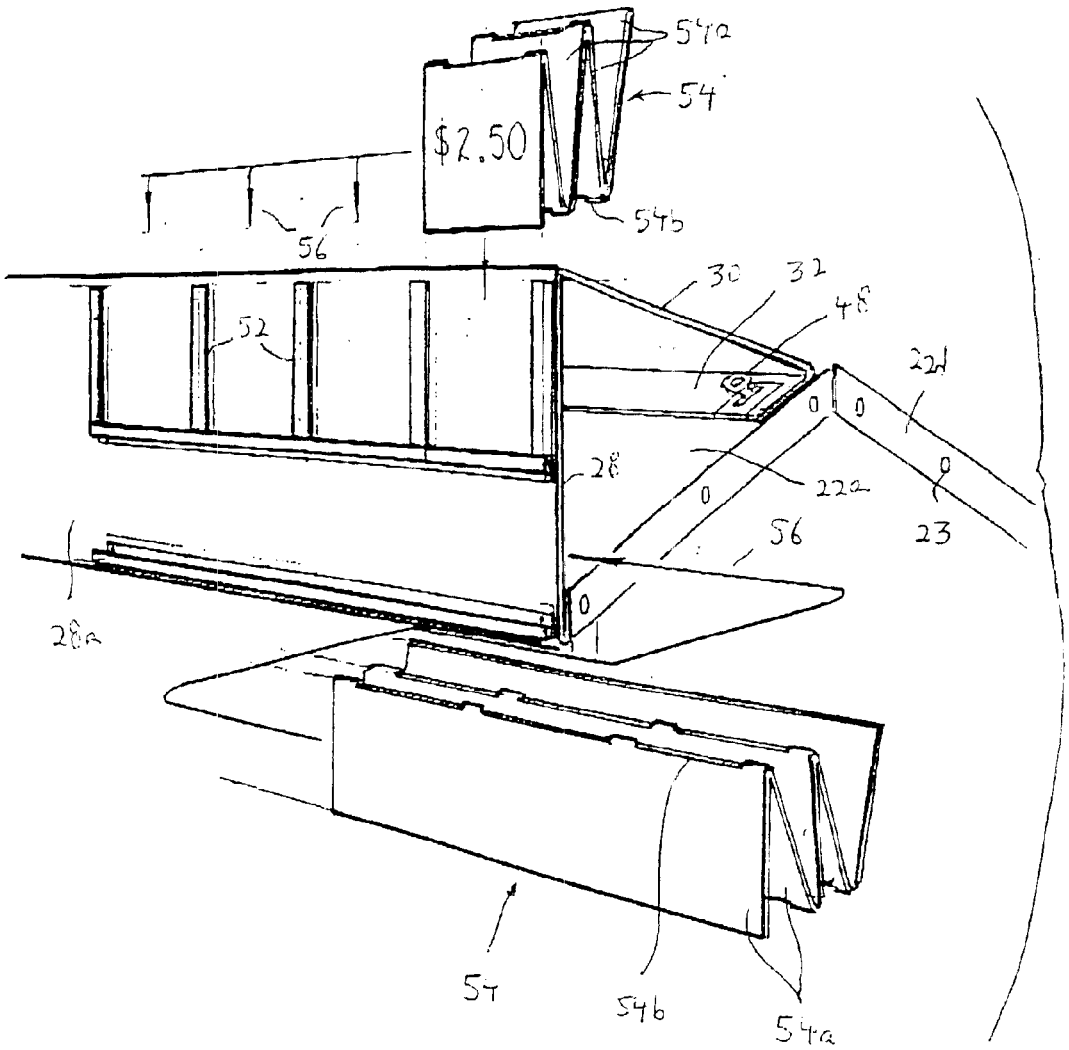
FIG. 8 is a blown apart, perspective view of a portion of the roof, showing the folded inserts.

In the open configuration of FIGS. 6 and 8, the rear surface 28*a* of second rectangular panel 28 faces outwardly. Rear surface 28*a* is provided with opposing sets of L-shaped channels 52. A folded insert member 54, preferably made of corrugated cardboard or plastic material, formed of a plurality of panels 54*a* hinged together in sequence by living hinges 54*b*, can be removably inserted in the direction of arrow 56 in FIG. 8, within respective sets of opposing L-shaped channels 52 for displaying pricing and other information. Each panel 54*a* has different information printed thereon. Each time that a price or other information changes, the respective insert 54 is removed from channels 52 and folded in a different manner so that the desired information can be viewed when insert 54 is replaced in the respective opposing L-shaped channels 52. Accordingly, unlike known arrangements, it is not necessary to provide numerous discrete panels with different information thereon, thereby reducing the burden of changing the pricing and other information.

Figure 9:
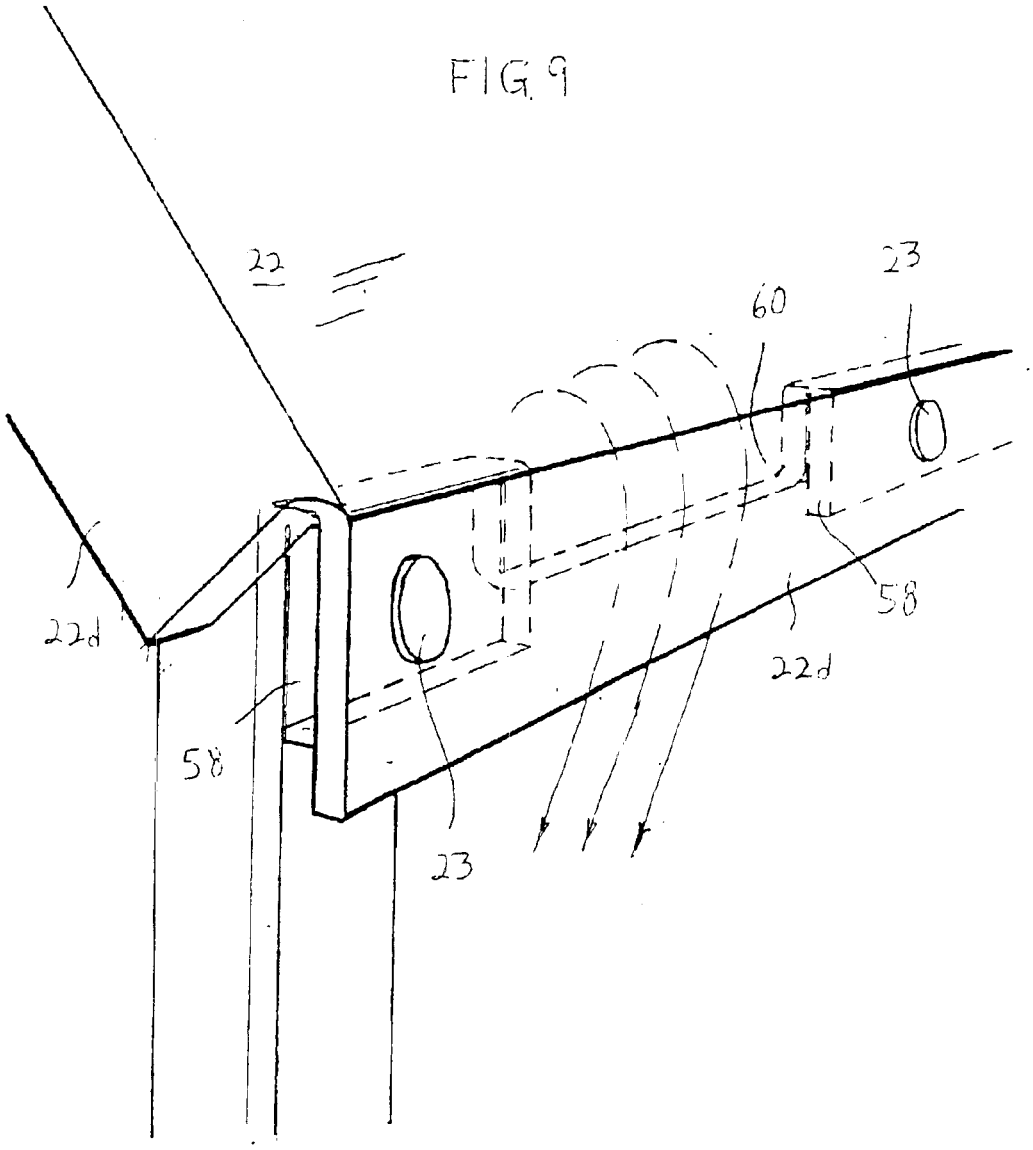
FIG. 9 is a perspective view of the top rear portion of the space station, showing the attachment of the roof to the rear wall in a manner to provide air vents.

In accordance with another aspect of the present invention, roof 22 is connected to the rear of display station 10 by bent over flanges that provide gaps as air vents so that air from the outside can circulate within display station 10 to prevent overheating of the products therein. Specifically, the upper edge of rear wall 14 is formed with spaced apart flanges 58 that are bent down over the rear surface at the upper end of rear wall 14, as shown in FIG. 9. Recessed openings 60 are provided at the upper edge of rear wall 14 between bent over flanges 58. In this manner, the rear end flange 22*d* of roof 22 is bent over flanges 58 and secured thereto by bolts 23. Because of this arrangement, it will be appreciated that rear end flange 22*d* is spaced away from rear wall 14 by the thickness of bent over flanges 58. As a result, this spacing and the formation of recessed openings 60 form air vents for the circulation of air into and out of display station 10, as shown by arrows.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention defined by the appended claims.

What is claimed is:

1. A point of sale display station for holding products to be sold, comprising:

a peripheral wall which forms an enclosure for the products, the peripheral wall having a substantially vertically oriented front surface with a front open area for removal of the products from the enclosure;

a roof secured to the peripheral wall, the roof extending substantially to the front surface of the display station;

a cover pivotally mounted at a top front section of the peripheral wall for movement between a first position in covering relation to the front open area and a second position above the front open area, the cover including a section which is substantially flush in alignment with and substantially parallel with the front surface of the display station and which has a display arrangement on a rear surface thereof which faces forwardly when the cover is in the second position for providing information regarding the products in the enclosure; and a securing arrangement for releasably securing the cover in the first and second positions.

2. A display station according to claim 1, wherein the roof is sloped to remove precipitation therefrom.

3. A display station according to claim 2, wherein the roof has an inverted V-shaped configuration.

4. A display station according to claim 1, wherein the securing arrangement includes at least one first swivel member on the peripheral wall and at least one second swivel member on the root, and the cover includes a panel having at least one opening therein for receiving the at least one first swivel member in the first position and the at least one second swivel member in the second position.

5. A display station according to claim 4, wherein each swivel member has an enlarged head for insertion through the at least one opening, and at least one said enlarged head has an opening for receiving a lock.

6. A display station according to claim 1, wherein the cover is formed from a plurality of panels which are hinged together.

7. A display station according to claim 6, wherein the cover includes at least one living hinge for hingedly connecting together said panel.

8. A display station according to claim 1, wherein the display arrangement includes at least one set of opposing L-shaped channels and at least one information insert which is insertable within said at least one set of opposing L-shaped channels, at least one said information insert being formed by a plurality of panels hinged together in sequence at edges thereof and each panel having different information indicia thereon.

9. A display station according to claim 1, further comprising a plurality of air vents extending in spaced apart relation along one lengthwise edge of the peripheral wall and formed between said roof and said peripheral wall for the circulation of air into and out of the display station.

10. A display station according to claim 1, wherein the peripheral wall includes spaced apart, bent over flanges that form double thickness sections, and the roof includes a bent peripheral flange which overlaps the bent over flanges so as to provide at least one air gap between the roof and the peripheral wall and between adjacent bent over flanges.

11. A display station according to claim 1, wherein the cover includes an arrangement for preventing said section of the cover from extending rearwardly past a substantially vertical orientation.

12. A display station according to claim 10, wherein the peripheral wall further includes at least one opening at a location between adjacent bent over flanges, for increasing the air flow through said air vents.

13. A point of sale display station for holding products to be sold, comprising:

a peripheral wall which forms an enclosure for the products, the peripheral wall including:

a rear wall, opposite side walls connected to the rear wall, a front panel removably secured to the opposite side walls for easily permitting restocking of product within the peripheral wall, and a front open area for removal of the products from the enclosure;

a bottom wall connected with the peripheral wall;

a roof secured to the peripheral wall, the roof extending substantially to a front surface of the display station;

a cover pivotally mounted at a top front section of the peripheral wall for movement between a first position in covering relation to the front open area and a second position above the front open area and substantially flush and parallel with the front surface of the display station, the cover including a display arrangement on a rear surface thereof for providing information regarding the products in the enclosure; and a securing arrangement for releasably securing the cover in the first and second positions.

14. A point of sale display station for holding products to be sold, comprising:

a peripheral wall which forms an enclosure for the products, the peripheral wall having a front open area for removal of the products from the enclosure;

a roof secured to the peripheral wall, the root extending substantially to a front surface of the display station;

a cover pivotally mounted at a top front section of the peripheral wall for movement between a first position in covering relation to the front open area and a second position above the front open area and substantially flush and parallel with the front surface of the display station, the cover including a display arrangement on a rear surface thereof for providing information regarding the products in the enclosure; and a securing arrangement for releasably securing the cover in the first and second positions; and said cover includes first through fourth panels which are hinged together in sequence, the first panel being fixed to the top front section of the peripheral wall, the second panel including said display arrangement on a rear surface thereof for providing information regarding the products in the enclosure and the fourth panel including part of the securing arrangement.

15. A display station according to claim 14, wherein the roof is sloped, and the third panel is sloped in the second position and forms a continuation of the sloped roof in the second position.

16. A display station according to claim 14, wherein the second panel is substantially flush and parallel with the front surface of the display station in the second position.

17. A display station according to claim 14, wherein the first through fourth panels are aligned in a planar configuration in the first position in covering relation to the front open area.

18. A point of sale display station for holding products to be sold, comprising:

a peripheral wall which forms an enclosure for the products, the peripheral wall having a front open area for removal of the products from the enclosure;

a roof secured to the peripheral wall;

a cover pivotally mounted to the peripheral wall for movement between a first position in covering relation to the front open area and a second position above the front open area;

a securing arrangement for releasably securing the cover in the first and second positions;

a plurality of air vents extending in spaced apart relation along one lengthwise edge of the peripheral wall and formed between said roof and said peripheral wall for the circulation of air into and out of the display station wherein the cover is formed from a plurality or panels which are hinged together in sequence, with a first one of said panels being fixed to the top front section of the peripheral wall, a last one of said panels including said securing arrangement and a first intermediate one of said panels including said display arrangement on a rear surface thereof for providing information regarding the products in the enclosure.

19. A display station according to claim 18, wherein the securing arrangement includes at least one first swivel plate on the peripheral side wall and at least one second swivel plate on the roof, and the cover includes a panel having at least one opening therein for receiving the at least one first swivel plate in the first position and the at least one second swivel plate in the second position.

20. A display station according to claim 18, wherein the cover is formed from a plurality of panels which are hinged together in sequence, with a first one of said panels being fixed to the top front section of the peripheral wall, a last one of said panels including said securing arrangement and a first intermediate one of said panels including said display arrangement on a rear surface thereof for providing information regarding the products in the enclosure.

21. A point of sale display station for holding products to be sold, comprising:

a peripheral wall which forms an enclosure for the products, the peripheral wall having a front open area for removal of the products from the enclosure;

a roof secured to the peripheral wall;

a cover pivotally mounted to the peripheral wall for movement between a first position in covering relation to the front open area and a second position above the front open area;

a securing arrangement for releasably securing the cover in the first and second positions; and the peripheral wall includes spaced apart, bent over flanges that form double thickness sections, and the roof includes a bent peripheral flange which overlaps the bent over flanges so as to provide at least one air gap between the roof and the peripheral wall and between adjacent bent over flanges.

22. A display station according to claim 21, wherein the peripheral wall further includes at least one opening at a location between adjacent bent over flanges, for increasing the air flow through said air vents.

23. A point of sale display station for holding products to be sold, comprising:

a peripheral wall which forms an enclosure for the products, the peripheral wall having a front open area for removal of the products from the enclosure;

a roof secured to the peripheral wall and the roof is sloped to remove precipitation therefrom;

a cover pivotally mounted to the peripheral wall for movement between a first position in covering relation to the front open area and a second position above the front open area, the cover being formed from a plurality of panels which are hinged together in sequence, with:

a first one of said panels being fixed to the top front section of the peripheral wall, a last one of said panels including said securing arrangement, a first intermediate one of said panels including a display arrangement on a rear surface thereof for providing information regarding the products in the enclosure and the first intermediate panel is substantially flush with a front surface of the display station in the second position, and a second intermediate panel which is sloped in the second position and forms a continuation of the sloped roof in the second position;

a securing arrangement for releasably securing the cover in the first and second positions; and air vents between said roof and said peripheral wall for the circulation of air into and out of the display station.

24. A point of sale display station for holding products to be sold, comprising:

a peripheral wall which forms an enclosure for the products, the peripheral wall having a front open area for removal of the products from the enclosure;

a roof secured to the peripheral wall, the roof extending substantially to a front surface of the display station;

a cover pivotally mounted at a top front section of the peripheral wall for movement between a first position in covering relation to the front open area and a second position above the front open area and substantially flush and parallel with the front surface of the display station, the cover including a display arrangement on a rear surface thereof for providing information regarding the poducts in the enclosure, said cover including a first panel which is non-pivotally secured to a top front section of the peripheral wall, and a second panel hingedly connected to said first panel; and a securing arrangement for releasably securing the cover in the first and second positions.

* * * * *